United States Patent [19]

Simm

[11] 4,383,019

[45] May 10, 1983

[54] PROCESS FOR ELECTROPHOTOGRAPHIC COLOR IMAGE DEVELOPMENT ON A CONTINUOUSLY MOVING IMAGE CARRIER

[75] Inventor: Walter Simm, Leverkusen, Fed. Rep. of Germany

[73] Assignee: Agfa-Gevaert Aktiengesellschaft, Leverkusen, Fed. Rep. of Germany

[21] Appl. No.: 294,478

[22] Filed: Aug. 20, 1981

[30] Foreign Application Priority Data

Aug. 30, 1980 [DE] Fed. Rep. of Germany ..... 3032835

[51] Int. Cl.[3] ..... G03G 13/10

[52] U.S. Cl. ..... 430/45; 430/48; 430/119; 430/103; 118/659; 118/650

[58] Field of Search ..... 430/45, 117, 118, 119, 430/33, 48, 103; 118/659, 660, 661, 662, 650

[56] References Cited

U.S. PATENT DOCUMENTS 3,854,813 12/1974 Kaufman ..... 430/48 X

*Primary Examiner*—John D. Welsh

*Attorney, Agent, or Firm*—Connolly and Hutz

[57] ABSTRACT

The invention relates to a process for electrophotographic color image development by which charge images are rendered visible by electrophoretic deposition of color zones on a continuously moving image carrier-band in development stations, using contact electrodes, development electrodes and blocking nozzles for the developer liquid whereby the development of the image in the development station is carried out with a substantial deviation $\alpha$ of the direction of movement of the image carrier from the horizontal.

14 Claims, 5 Drawing Figures

Figure 1:
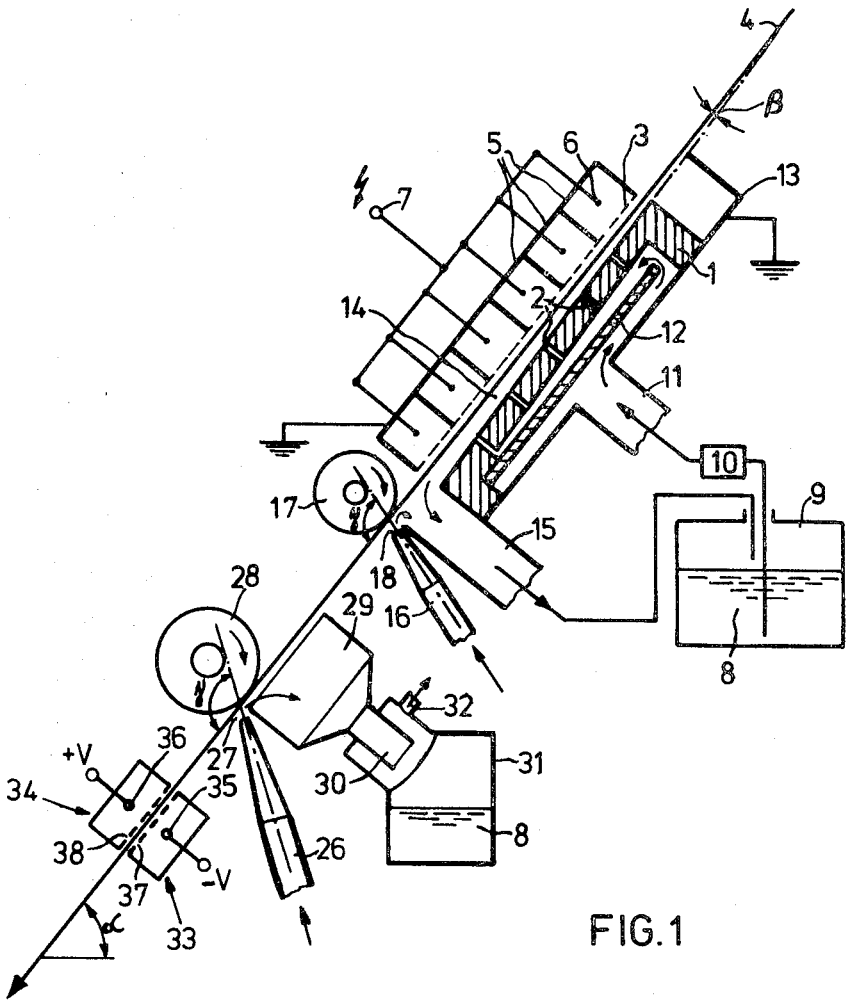

PROCESS FOR ELECTROPHOTOGRAPHIC COLOR IMAGE DEVELOPMENT ON A CONTINUOUSLY MOVING IMAGE CARRIER

This invention relates to a process for electrophotographic colour development by which charge images are rendered visible by electrophoretic deposition of colour toners on an image carrier in the form of a continuously moving band in development stations, using contact electrodes, development electrodes and blocking nozzles for the developer liquid.

It is known that colour separation images in the subtractive primary colours of cyan, magenta and yellow can be produced from a colour original by means of suitable colour filters and development apparatus and that these partial colour images can be recombined to a complete colour image by placing them one above the other in exact registration.

It is also known that a latent electric charge image can be produced electrophotographically by projection of an image on a precharged photoconductive layer, and that this charge image can be transferred to a thin, insulating film. This secondary charge image can be rendered visible on the films by electrophoretic development.

If an arrangement of three electrophotographic copying units is assembled (in known manner) so that each unit delivers a separation image in one of the above mentioned primary images are brought into register, an electrophotographic colour copy of the original is obtained.

In U.S. Pat. No. 4,168,973, there is described a process by which separation images of a colour original are applied as charge images to a stretched strip to film moving continuously in one direction, and the separation images are brought into register by suitable control of the transferring elements. In this process, the film passes through a development station after each transfer of a charge image, and in this development station the image is rendered visible in the appropriate separation colour. It is important that only that side of the film which carries the image should be brought into contact with the electrophoretic developer and that the developer liquid should approach the horizontally moving strip from below.

By using colour filters, the primary charge images corresponding to the colour separation images are produced on the surface of photoconductive layers which are applied to metal drums. These drums are arranged in a row at suitable intervals so that each drum touches the back of the strip of film at the position of image transfer. This transfer of the image is effected at these positions by charging of the opposite side (image side) of the film to a potential which is the same at every point, whereby the charge density is automatically distributed imagewise on the surface of the film. Image transfer tubes of known type which are supplied with nitrogen are used for application of the charge.

In this procedure, complete synchronisation of movement between the surface of the drum and the strip of film is necessary. This in turn requires each drum to be supplied with a synchronised drive since the forces of adherence at the points of contact in the stretched strip are insufficient to enable the movement to be transferred, without slipping, to a drum which is not driven. Under the given conditions, it is not possible to increase the forces of adherence by partially wrapping the strip around the drum since the hitherto known development stations are only capable of functioning when the electrode is in the horizontal position. Under the given conditions, however, that the strip must be wrapped around at least three drums and the strip must always continue to curve in one direction only, the arrangement of development stations would have to be set at an angle.

Providing a separate drive for each drum has the disadvantage that slight differences in the diameters of the drums or slight eccentricities in the positions of their axes would inevitably cause a shift in the relative position between the drum and the strip.

Keeping the moving strip taut has the further disadvantage that the surface of contact between the strip and the drum is very narrow so that only slight vibrations of the band are sufficient to impair the contact. The obvious solution of increasing the surface area by curving and partially wrapping the film around the drum at this point is not possible because the development station can only function in the horizontal position.

The production of colour copies by the process described above also makes high demands on the quality of the developer, not only in that the toner must adhere firmly to its substrate but also in that the specific charge of the particles must be maintained within a relatively narrow range.

Most of the developers which could be used in practice contain particles of colour toner which do not adhere sufficiently firmly to the surface of a smooth film, so that the image is liable to lack sharpness and clarity. These problems are particularly liable to arise when higher toner concentrations are used in the developer liquid for the purpose of obtaining high color densities in the image. If different types of toner differ in their strength of adherence, the less firmly adhering toner particles become detached from the substrate in the thin liquid layer and are displaced with or in the liquid to other parts of the image so that a washed-out and blurred appearance is produced.

Under operating conditions which are suitable for production purposes, i.e. at high strip velocities and consequently short residence times of the image carrier in the development station, the charge in the image to be developed is not completely neutralised by the deposition of the toner and substantial residual charges are left on the carrier. These residual charges cause after-development in the next development station through which the image carrier is passed. Since this next development is carried out using a differently coloured toner, a falsification of colour results.

For high copying speeds, the drying time for the carrier strip is of great importance for removal of the liquid layer, and relatively long drying passages are necessary in a continuous process.

It is therefore an object of the present invention to provide an improved development process of the type indicated above, in which the disadvantages described above do not occur in an electrophotographic colour copying process.

Proceeding from a process of the type described initially, the problem according to the invention is solved by carrying out the development of the image in a development station in which the direction of movement of the image carrier deviates by a considerable angle $\alpha$ from the horizontal.

The process enables the development apparatus and the drums to be arranged in such a manner that they are at the same distance from a common reference point and the image carrier can be wrapped over a sufficient angle around the drums which are set with their axes parallel, this angle ensuring precise correspondence of the circumferential velocity of the drums to the velocity of the image carrier and a large surface of contact between the image carrier and the image transfer rollers.

In one advantageous embodiment, the image carrier is transported along the flat surface of the contact electrode, and this surface and the surface of the development electrode define an angle $\beta$ opening in the direction of movement of the image carrier.

It was surprisingly found that even a slight deviation of the disposition of the electrode surfaces from parallel has a marked effect on the flow of liquid in that there is a tendency for the liquid layer to form a constriction in the direction of transport of the strip. The extent to which the stream of liquid becomes constricted in the lower part of the development zone varies according to the size of the opening angle, the quantitative rate of flow of liquid and the inclination. In order to maintain suitable flow conditions such that the developer liquid still completely fills the space above the development electrode but does not spread out laterally over the edge of the electrode, and opening angle $\beta$ is adjusted to from 0.1° to 3°, preferably 0.5° to 1°.

Instead of the three blocking nozzles, one curved blocking nozzle or a v-shaped blocking nozzle may be used.

The prevention of the spread of the liquid layer over the lateral boundaries of the development zone is necessary but not sufficient for stable operation of the development apparatus, since the quantity stored in front of the straight blocking nozzle of the known type of development station is frequently so great that subsequent spreading along the edges of the nozzle is unavoidable if the development station is in an inclined position.

The means of controlling the flow conditions consists of using specially shaped blocking nozzles or combinations of blocking nozzles so that in the marginal zones of the carrier strip, the air streaming out of the nozzle produces a flow component directed towards the middle.

In one particularly advantageous process, the image carrier, after having passed through the development zone, is moved past a combination of blocking nozzles consisting of a frontal nozzle having an air outlet aperture disposed transversely to the image carrier and two lateral nozzles arranged symmetrically to one another in the marginal zones so that the mid-lines of their outlet apertures converge in the direction of movement of the image carrier.

Development stations of the type of construction described above are completely stable and functional at strip velocities of, for example, 20 cm/s and an angle of inclination $\alpha$ of 50°.

Another unexpected advantage is found in a process in which the image carrier, immediately after having passed through the development station, is moved past an air wiper which is operated at a higher air pressure than the blocking nozzle of the development station. The air pressure in front of the air outlet aperture of the air wiper is adjusted to 2 to 20 times, preferably 5 to 10 times the pressure in the blocking nozzle of the development station.

It was surprisingly found that a colour toner image applied by the development process, which several seconds after completion of development still shows signs of smudging in the liquid layer which is still present at this stage, still adheres so firmly to its support immediately after deposition of the toner that it will withstand intensive after-treatment with an air wiper. By "air-wiper" is meant an air nozzle of the same form of construction as the blocking nozzle but used outside the development unit and at a substantially higher operating pressure.

The velocity of air outflow is so high that the amount of liquid which is detrimental to the durable adherence of the toner can be removed by the pressure of the air stream. The residual liquid remaining after this treatment can quickly be removed by hot air drying of the completed image composed of all the colours. The treatment with the air wiper is carried out after each development of a colour separation.

The width of the air gap both of the blocking nozzle and of the air wiper ranges from 0.1 to 0.4 mm and is preferably 0.2 mm. Both outlet apertures for the compressed air are arranged at a distance of from 0.2 to 0.1 mm from the image side of the image carrier. This distance is preferably 0.4 mm.

The angle $\gamma$ between the direction at which the air is blown from both nozzles and the direction of movement of the image carrier is in the range of from 90° to 135° and is preferably 110°.

The operation of the process for application of the air wiper is to a large extent independent of the angle of inclination of the image carrier. The process may therefore easily be carried out with development stations which are capable of operating at a steep inclination.

It has also been found that it is advantageous to the process if, after treatment of the image carrier with the air wiper, the residual charge on the image is removed by the application of gas ions by means of grid electrodes.

The process for the electrophotographic development of colour images provides colourfast, smudge-free images which the special development process enables to be produced. When colour images are to be produced from three or more colour separations, a corresponding number of developments are carried out one after the other. The process enables the use of drums on which the electrostatic charge images are produced and subsequently copies onto the image carrier, which drums are arranged with their axes parallel and equidistant from a common reference point and are rotated by the image carrier making contact with them and partially enveloping them. The drums rotate at a circumferential velocity which is exactly equal to the velocity of the band. This provides a very advantageous mode of driving which enables the toner image to be transferred from the transfer roller to the image carrier without distortion or delay while the carrier is partially wrapped around the transfer roller.

An embodiment of the invention is described in more detail below with reference to the drawings, in which FIG. 1 shows the mode of operation of a development station inclined at an angle.

Figure 2A:
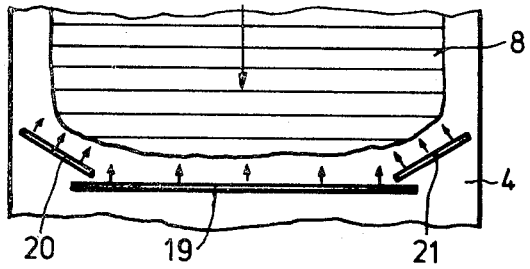

FIGS. 2*a*, *b* and *c* show the arrangement of the blocking nozzles, and

Figure 3:
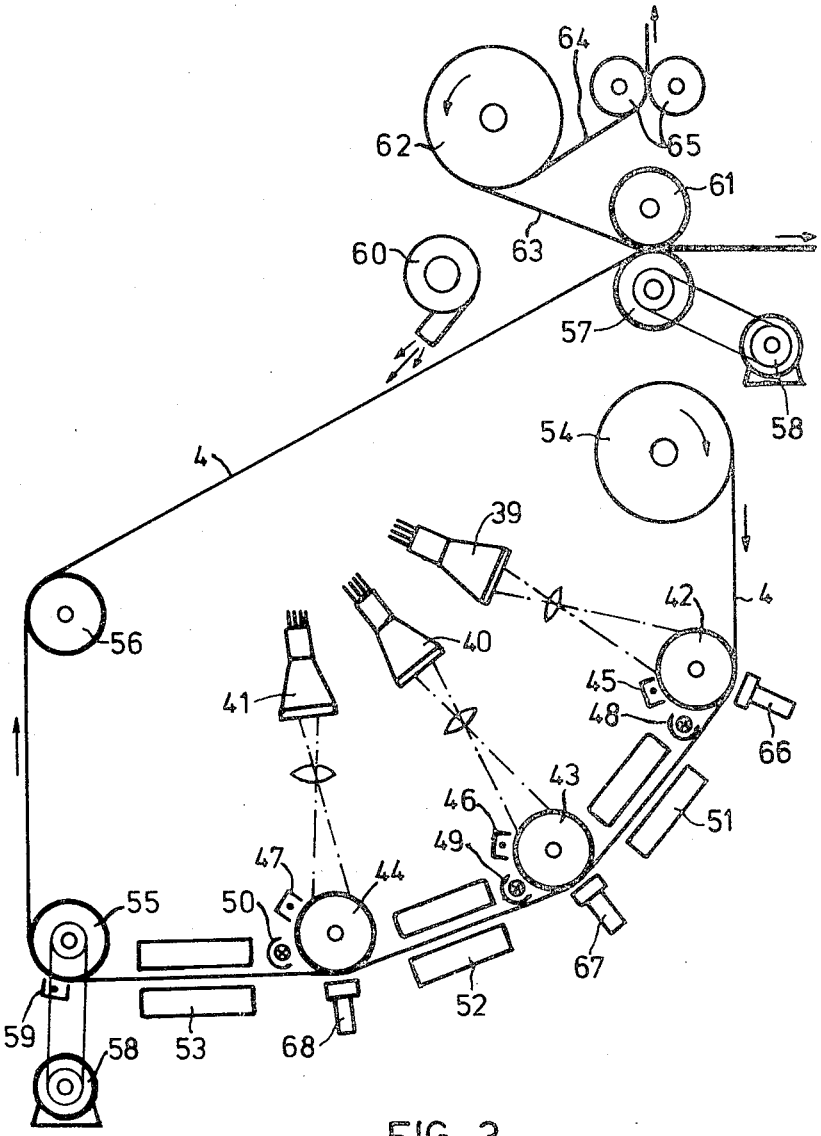

FIG. 3 shows an embodiment of the arrangement of the essential elements of an electrophotographic colour copying apparatus.

FIG. 1 shows the development unit consisting of a development electrode 1, a metal block perforated with channels 2 for the passage of liquid, a grid electrode 3 as support for the strip of image carrier 4 and an arrangement of known Korotron units 5 having their electrical discharge wires 6 connected to a common high voltage lead 7. The developer liquid 8 is taken from container 9 by a pump assembly 10, pumped into the feed pipe 11 and over a distributor plate 12 and uniformly distributed through the channels 2 from where it enters the development zone 14 between the flat electrode surface and the strip of image carrier. The image carrier 4 is wetted with developer liquid 8 only on its underside and only an area which does not extend to the edge of the band. The liquid 8 flows over the edge of the development electrode 1 and through return channels (not shown) into the tank 13 from where it is returned to the container 9 by way of the return pipe 15 and another pipe connected thereto. The image carrier 4 travels through the apparatus from the top righthand corner to the bottom lefthand corner in the direction of the arrow, touching with its reverse side the grid electrode 3 and the guide cylinder 17 while the charge image side of the carrier comes into contact with the developer liquid 8 in the development zone 14. The blocking nozzle 16 prevents liquid 8 from leaking out at the lower boundary wall of the tank 13. For this purpose, air is introduced under pressure into the nozzle in the direction of the arrow and forced under pressure against the image carrier through a narrow outlet gap 18 which is arranged transversely to the direction of movement of the image carrier 4.

The development station constructed as described here is capable of functioning if the image carrier travels through it horizontally or at a slight inclination with a gradient $\alpha$ of, for example, 5 to 10 degress. Under a steep gradient, in which the image carrier 4 makes an angle $\alpha$ with the horizontal of, for example, 50 degrees, the liquid 8 flows forwards under gravity until it is close to the opening gap 18 of the nozzle 16, it accumulates in front of the nozzle 16 and escapes sideways to flow out in an uncontrolled manner.

Two measures are provided to prevent this from happening, so that the development may also be used with the direction of movement of the carrier band deviating at considerable angles $\alpha$ from the horizontal.

The first measure is that the flat surfaces of the electrodes enclosing the development zone 14, namely the grid electrode 3 and the development electrode 1, are not arranged parallel to each other but define an angle $\beta$ which opens in the direction of movement of the band.

It was surprisingly found that a slight deviation of the disposition of the electrode surface from parallel is sufficient to produce a very marked effect on the flow of liquid, with the result that the layer of liquid shows a tendency to form a construction in the direction of transport of the image carrier 4. The extent to which the liquid stream becomes constricted in the lower part of the development zone 14 depends on the magnitude of the opening angle $\beta$, the rate of flow of liquid and the angle $\alpha$. For maintaining suitable flow conditions, the opening angle $\beta$ is chosen to be from 0.1 to 3 degrees, preferably from 0.5 to 1 degree.

Concentration of the liquid 8 in the middle part of the carrier strip as it leaves the development zone is necessary but not sufficient for stable operation of the development unit since the quantity of liquid accumulated in front of the blocking nozzle 16 is frequently so great that the liquid cannot be prevented from subsequently flowing over the edge of the image carrier 4.

The second of the above mentioned measures for controlling the flow conditions is to use specially shaped blocking nozzles or combinations of blocking nozzles which produce a flow component of the outflowing are directed from the marginal zones towards the middle of the carrier strip.

Figure 2B:
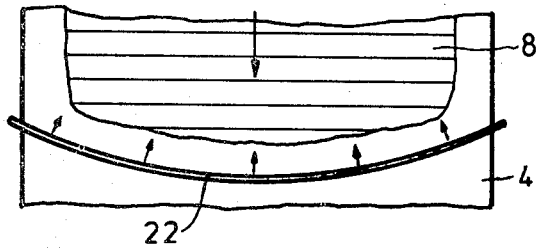
Figure 2C:
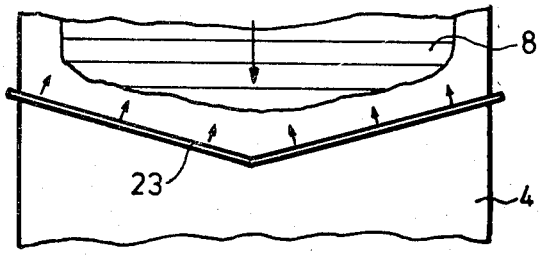

Examples of nozzles arrangements of this type are shown in FIGS. 2*a* to *c*.

The combination of blocking nozzles of FIG. 2*a* comprises a frontal nozzle 19 having its outlet gap arranged transversal to the image carrier 4 and two side nozzles 20,21 arranged symmetrically to each other in the marginal zones so that the extensions of their midlines in the longitudinal direction of the gap converge the direction of movement of the image carrier.

FIG. 2*b* shows a form of nozzle in which the air outflow gap has a curvature whose centre is situated on the mid-line of the strip upstream of the nozzle 22, relative to the direction of movement.

In FIG. 2*c*, the nozzle 22 is v-shaped and comprises two straight portions set at an angle to each other, with the apex of the angle pointing in the direction of movement of the carrier strip.

Development stations constructed as described above are surprisingly found to be completely stable and functional at strip velocities of, for example, 20 cm per second and an angle of inclination $\alpha$ of 50 degrees.

The technical flow problems and the counter measures to be provided on the development apparatus for carrying out the development process have been described with reference to FIGS. 1 and 2.

Another advantageous feature of the process concerns an after-treatment of the developed surface of the image carrier as an extension of the development process, especially to reduce blurring in the image due to washing-out and provided improvements in the lengthy drying process.

For effective operation of the blocking nozzle 16, the permissible air pressure in front of the opening gap of the nozzle is limited by the fact that it must be high enough to prevent the liquid 8 from breaking through the barrier zone of the nozzle 16 but it must be low enough to prevent atomisation of the liquid 8 and thus ensure that the liquid will flow back into the receiver 13.

When the gap of the nozzle 16 has a width of 0.2 mm and a distance between the nozzle opening and the image carrier is 0.4 mm, for example, the permissible operating pressure is from 9 to 11 m bar. Under these conditions the layer of liquid left behind after development of an image on a carrier which is substantially non-absorbent, e.g. a polyester film, is from 1 to 2 $\mu$m in thickness. Such a layer is capable of absorbing a fresh charge image after it has passed through the transfer device but promotes subsequent running of the developed image.

It has now surprisingly been found that a colour toner image which has been applied in the development process and which, several seconds after completion of development, shows signs of washing out the blurring in the layer of liquid left on it at that stage, still adheres so firmly to its support after toner deposition that it will withstand intensive after-treatment with an air wiper. By this is meant an air nozzle which is similar in construction to the blocking nozzle 16 but is used outside the development station and at a substantially higher operating pressure.

The air outflow velocity is so high that the liquid which is detrimental to the durable adherence of the toner can be removed by the pressure of the air current. The small quantity of remaining liquid may then be quickly removed by hot air drying of the completed image containing all the colours. Treatment with the air wiper is carried out after each development of a colour separation.

The improvement of the system thus subsists in that the image carrier is moved past an air wiper 26 (FIG. 1) immediately after its passage through the development station, which air wiper is operated at a higher air pressure than the blocking nozzle of the development station.

FIG. 1 shows the air wiper 26 with air outflow aperture 27 situated below the guide cylinder 28. A collecting tank 29 is situated upstream of the wiper 26, relative to the direction of movement of the image carrier 4. This tank 29 has a discharge pipe 30 extending into a suction bottle 31. Removal of the air by suction through the connection 32 for a suction device prevents the liquid droplets which become detached from the carrier band by the air stream from getting into the surroundings. As the image carrier 4 moves through the arrangement shown in FIG. 1, the powerful air current from the wiper 26 pushes the liquid film together on the surface of the carrier, and the liquid 8 drips into the collecting tank 29.

The air pressure in front of the outlet aperture of the air wiper 26 is adjusted to from 2 to 20 times the pressure in the blocking nozzle 16, preferably to from 5 to 10 times that pressure.

The width of the air gap both of the blocking nozzle 16 and of the air wiper 26 is from 0.1 to 0.4 mm, preferably 0.2 mm. Both outlet apertures for compressed air are situated at a distance of from 0.1 to 1.0 mm from the image side of the image carrier. This distance is preferably 0.4 mm.

The angle $\gamma$ between the direction of the jet of air from the two nozzles and the direction of movement of the carrier strip is from 90 to 135 degrees, preferably 100 degrees.

The function of the arrangement described for the application of the air wiper 26 is to a large extent independent of the angle of inclination $\alpha$ of the carrier strip. The apparatus may therefore readily be combined with development stations which also function at a steep angle.

It has been found advantageous to neutralize the residual charge on the developed image surface. Devices 33 and 34 are Korotron units of a known type. The discharge wires 35 and 36 are connected to sources of direct voltage at potentials of opposite signs (+V and −V) so that when corona discharge takes place they emit negative and positive gas ions which pass through the grid electrodes 37 and 38 to reach the image carrier 4.

In this way, when the residual liquid is swept from the image carrier 4, the residual charge is also removed by the application of gas ions through the grid electrodes 37, 38.

The polarity of the ions depends on the sign of the charge of the image. If the charge was negative, for example, the residual charge will also be negative and must be compensated by positive ions on the image side.

When the improvements shown in FIGS. 1 and 2 for electrophotographic image development are applied to the known process for the production of colour copies described above, according to the invention the disadvantages mentioned may be obviated. Thus the colour copy of a coloured original is produced as follows in the arrangement shown in FIG. 3;

After scanning of an original image by known optoelectronic means, colour separation images in red, green and blue are projected on the surface of metal drums 42, 43, 44 by means of projectors 39, 40, 41. The surface of these metal drums is coated with a photoconductor. For continuous transfer of images, a relative displacement is introduced between the scanning element and the original image, and the partial images are transferred to drums 42, 43 and 44 which rotate in the same sense. The velocities are adjusted to the enlargement required so that no image distortion is produced on the surface of the drums. Corona charging devices 45, 46, 47 are used to produce a homogeneous charge on the photoconductive layer before exposure. Subsequent exposure converts this homogeneous charge into an imagewise distribution of charge. The charge image obtained for each colour separation is copied on to the image carrier 4 in known manner at the points of contact of the drums with the image carrier 4, using transfer tubes 66, 67, 68. The image carrier 4 in the form of a strip consists of a transparent, insulating material, e.g. a polyester film or polycarbonate film. After image transfer, the charge remaining on the photoconductive layer is removed by diffuse exposure with discharge lamps 48,49, 50, and the layer is then again homogeneously charged.

Immediately after transfer of the image, the recopied charge image is transferred by the continuously moving image carrier 4 into one of the development apparatuses 51, 52, 53 shown in FIG. 1, in which the separation image is developed in the complementary colour. Thus the red separation obtains the cyan colour, the green separation the magenta colour and the blue separation a yellow colour. The sequence of images and the velocity of the image carrier are adjusted to each other so that a colour image is finally obtained by applying the partial images above one another in correct registration.

Movement of the image carrier 4 is controlled in such a manner that the strip of film is taken from the supply roll 54 and transported in a mechanically taut state over the drums 42, 43, 44, 55, 56, and 57. The element which determines the velocity is the main driving drum 55, which is driven by a motor 58. To increase the force of adherence in this region, the band is electrically charged, using a Korotron 59. A second drive motor 58, which drives the drum 57, provides the traction for the subsequent passage of the image carrier 4. The image carrier 4 first travels with the developed image through a drying passage between the drums 56 and 57 in which the remainder of developer liquid is removed by means of a hot air blower 60. Between the drums 57 and 61, the transparent image carrier 4 is backed with a white support 63, and the toner image is fixed in the interface between the film and the support. The material used for this support may be, for example, self-adhesive white paperboard which is taken from the roll 62 and pressed to the film by its adhesive layer. A protective film 64 for the adhesive layer of the white support 63 is removed by the pair of drums 65.

The apparatus described in FIG. 3 produces colourfast, smudgefree images, the production of which is made possible by the special development stations according to the invention. One particular technical feature of the apparatus for carrying out the process is the arrangement of the drums in such a manner that while placed with their axes parallel, they are equidistant from a common reference point. A further feature is that the drums coated with photoconductor are driven solely by their contact with the moving carrier strip. This mode of driving, which is advantageous in view of the required precise correspondence between the circumferential velocity of the drums and the velocity of the strip, was only made possible by the partial enveloping of the drums by the strip, which in turn necessitated the oblique positioning of the development station according to the invention.

I claim:

1. A process for electrophotographic colour image development by which charge images are rendered visible by electrophoretic deposition of colour toners on a continuously moving image carrier in the form of a band in at least two development stations, using contact electrodes, and development electrodes wherein the improvement comprises using blocking nozzles for the developer liquid, and that the development of the image in each development station is carried out with a deviation angle $\alpha$ of 0° to 50° of the direction of movement of the image carrier from the horizontal plane.

2. A process according to claim 1, characterised in that the image carrier, after having passed through the each development station, is moved past a combination of blocking nozzles comprising a frontal nozzle having an air outflow aperture arranged transversel to the image carrier and two side nozzles arranged symmetrically to each other in the marginal zones so that the mid-lines of the outflow apertures converge in the direction of movement of the image carrier.

3. A process according to claim 1, characterised in that the image carrier, after having passed through the each development station, is moved past a blocking nozzle in which the air outflow aperture has a curvature whose centre is situated in the middle of the image carrier, upstream of the blocking nozzle, relative to the direction of transport of the image carrier.

4. A process according to claim 1, characterised in that the image carrier, after having passed through the each development station, is moved past a v-shaped blocking nozzle consisting of two straight parts defining an angle whose apex points in the direction of transport of the image carrier.

5. A process according to claim 1, characterised in that the image carrier, immediately after having passed through the development station, is moved past an air wiper which is operated at a higher air pressure than the blocking nozzle of the development station.

6. A process according to claim 5, characterised in that the air pressure in front of the air outflow aperture of the air wiper is adjusted to 2 to 20 times, preferably 5 to 10 times the pressure in the blocking nozzle of the development station.

7. A process according to claims 2 or 5, characterised in that the width of the air outflow aperture both of the air wiper and of the blocking nozzle is adjusted to a value from 0.1 to 0.4 mm, preferably to 0.2 mm.

8. A process according to claims 2 or 5, characterised in that the air outflow apertures of the air wiper and of the blocking nozzle are arranged at a distance of 0.1 to 1.0 mm, preferably a distance of 0.4 mm from the image side of the image carrier.

9. A process according to claims 2 or 5, characterised in that both for the air wiper and for the blocking nozzle, the angle between the direction of the jet of air and the direction of movement of the image carrier is from 90 degrees to 135 degrees and is preferably 110 degrees.

10. A process according to claim 1, characterised in that after the image carrier has been wiped, the residual charge on the image is removed by the application of gas ions through grid electrodes.

11. A colour copying process by which colour separation images of a coloured original are produced as electrostatic charge images on metal drums coated with a photoconductor and are then recopied on an image carrier in the form of a strip, and development of each partial image is carried out after each recopying, characterised in that a process according to claims 1 to 6 is employed for the image development.

12. A process according to claim 1, characterised in that the drums used are placed with their axes parallel and are equidistant from a common reference point.

13. A process according to claims 11 or 12, characterised in that the drums are set into rotation by contact with the moving carrier strip.

14. In the process of developing the image according to claim 1, moving the image carrier past flat surfaces of the contact electrodes, which surfaces define an angle $\beta$ of from 0.1 to 3 degrees with the carrier and the angle $\beta$ opening in the direction of transport of the image carrier.

* * * * *